US006053420A

United States Patent [19]

Ahlbert et al.

[11] Patent Number: 6,053,420

[45] Date of Patent: Apr. 25, 2000

[54] DISPERSION APPARATUS AND PROCESS FOR PRODUCING A LARGE CLOUD OF AN ELECTROSTATICALLY CHARGED POWDER/AIR MIXTURE

[75] Inventors: Enar Ahlbert, Växjö; Lars-Erik Johansson, Älmerboda, both of Sweden; Gunter Börner, Mühlhausen, Germany; Johann Nienburg; Anton Puhane, both of Heidelberg, Germany

[73] Assignee: ABB Research Ltd., Zurich, Switzerland

[21] Appl. No.: 09/264,278

[22] Filed: Mar. 8, 1999

Related U.S. Application Data

[63] Continuation-in-part of application No. 08/837,239, Apr. 10, 1997, abandoned.

[30] Foreign Application Priority Data

Apr. 10, 1996 [DE] Germany ..... 196 14 192

[51] Int. Cl.[7] ..... B05B 5/03

[52] U.S. Cl. ..... 239/3; 239/8; 239/298; 239/403; 239/707

[58] Field of Search ..... 239/3, 8, 403, 239/405, 432, 296, 298, 704, 705, 706, 707

[56] References Cited

U.S. PATENT DOCUMENTS

| | | | |
|---|---|---|---|
| 2,879,003 | 3/1959 | Finn . | |
| 3,310,240 | 3/1967 | Grundman . | |
| 3,540,653 | 11/1970 | Fabre . | |
| 3,659,151 | 4/1972 | Fabre . | |
| 3,740,612 | 6/1973 | Gauthier et al. . | |
| 3,940,061 | 2/1976 | Gimple et al. . | |
| 4,020,393 | 4/1977 | Porter | 239/707 X |
| 4,135,667 | 1/1979 | Benedek et al. . | |
| 4,228,961 | 10/1980 | Itoh | 239/707 X |
| 4,235,381 | 11/1980 | Vila . | |
| 4,630,777 | 12/1986 | Hollstein et al. . | |
| 4,688,518 | 8/1987 | Missier . | |
| 4,772,982 | 9/1988 | Nagasaka | 239/707 X |
| 5,188,296 | 2/1993 | Duez et al. . | |
| 5,297,733 | 3/1994 | Burks et al. . | |
| 5,322,222 | 6/1994 | Lott . | |
| 5,351,903 | 10/1994 | Mazakas et al. . | |
| 5,711,489 | 1/1998 | Yanagida et al. . | |

FOREIGN PATENT DOCUMENTS

| | | |
|---|---|---|
| 1 475 162 | 1/1969 | Germany . |
| 23 38 752 | 1/1975 | Germany . |
| 25 14 411 | 2/1976 | Germany . |
| 30 14 133 A1 | 10/1981 | Germany . |
| 32 42 362 A1 | 5/1984 | Germany . |
| 36 44 849 A1 | 9/1987 | Germany . |
| 37 25 672 A1 | 2/1989 | Germany . |
| 641 691 | 3/1984 | Switzerland . |

OTHER PUBLICATIONS

International Publication No. WO 88/06493 (Suniewski et al.), dated Sep. 7, 1988.

Patent Abstracts of Japan No. 4–330957 A (Yamada), dated Nov. 18, 1992.

*Primary Examiner*—Andres Kashnikow
*Assistant Examiner*—Steven J. Ganey
*Attorney, Agent, or Firm*—Herbert L. Lerner; Laurence A. Greenberg; Werner H. Stemer

[57] ABSTRACT

A process and a dispersion apparatus for shaping a powder cloud emerging from a powder spraying apparatus achieve large powder clouds and good electrostatic charging by directing control air in a tangential direction towards a powder/air stream flowing through the dispersion apparatus in an axial spraying direction. A helically accelerated movement of the powder/air stream in the direction of an outlet is achieved thereby.

16 Claims, 2 Drawing Sheets

DISPERSION APPARATUS AND PROCESS FOR PRODUCING A LARGE CLOUD OF AN ELECTROSTATICALLY CHARGED POWDER/AIR MIXTURE

CROSS-REFERENCE TO RELATED APPLICATION

This application is a continuation-in-part of application Ser. No. 08/837,239, filed Apr. 10, 1997, now abandoned.

BACKGROUND OF THE INVENTION

Field of the Invention

The invention relates to a process and a dispersion apparatus for the production of a powder cloud that is produced when a powder/air mixture emerges from a powder spraying apparatus.

The dispersion apparatus is particularly suitable for spraying apparatuses in which the powder/air mixture emerges from a fluidization chamber through a nozzle. However, it can also be used in other systems, such as a spraying apparatus in which the dispersion apparatus is fed a powder/air mixture through a hose.

In German Published, Non-Prosecuted Patent Application DE 195 37 089 A1, corresponding to U.S. application Ser. No. 08/726,815, filed Oct. 7, 1996, a powder spraying apparatus is described which has a fluidization chamber from which fluidized powder is withdrawn from a fluidized bed with the aid of a withdrawal pipe and passes to the outside through a nozzle. High-voltage electrodes which are disposed in the region of the outlet effect charging of the emerging powder particles.

In the above-mentioned patent application, a configuration of a baffle on which the powder/air mixture emerging from the nozzle impinges and through which a defined powder cloud is developed, is proposed as a dispersion system. However, with that small baffle only specific, relatively small spray clouds may be developed, which are not sufficiently large for some applications. In addition, powder depositions on the baffle may occur in such a configuration. The use of larger baffles in order to produce a large cloud is therefore ruled out because of the more severe powder deposition on the baffle that occurs in this case.

In order to generate a relatively broad powder cloud while avoiding powder deposits, Published European Patent Application 0 574 305 A1 proposes a dispersion system having a rapidly rotating disc, wherein rotational speeds of over 3000 rev/min are used. However, such systems are mechanically sensitive and have only a limited lifetime in powder spraying apparatuses.

U.S. Pat. No. 3,659,151 and U.S. Pat. No. 3,740,612 describe dispersion systems that operate with additional air that is introduced tangentially in order to produce a powder cloud. In these systems, however, use is also made of central baffles, on which powder may be deposited. The geometry of the configurations is not suitable for spraying powder/air mixtures with a high powder loading, nor for producing large spray clouds.

SUMMARY OF THE INVENTION

It is accordingly an object of the invention to provide a dispersion apparatus and a process for producing a large cloud of an electrostatically charged powder/air mixture that overcome the above-mentioned disadvantages of the prior art devices and methods of this general type, which permit relatively widespread, large spray clouds with a high powder loading, no rotating parts are used and powder depositions in the dispersion apparatus are avoided.

With the foregoing and other objects in view there is provided, in accordance with the invention, a method for producing a large cloud of an electrostatically charged powder/air mixture with a high powder content, which includes: providing a dispersing device having a tube, a nozzle connected to an entry end of the tube, and a funnel-shaped outlet having an exit diameter from 50 to 170 mm connected to an outlet end of the tube, the tube having a length in a range from 70 to 130 mm, an internal diameter in a range from 13 to 23 mm, a wall defining a hollow interior therein, and a plurality of holes formed in the wall of the tube; introducing a fluidized powder being a powder/air flow into the hollow interior transversely at a location situated at a distance of 65 to 75% of the length of the tube from the outlet end of the tube; introducing compressed air as control air into the hollow interior tangentially through the plurality of holes in the tube at least at a first location at a distance of 80 to 95% of the length of the tube from the outlet end of the tube, the control air being introduced tangentially to the air/powder flow for providing the air/powder flow with a tangential impulse in addition to an axial impulse; and electrostatic charging the powder/air flow with high-voltage electrodes in a region where the powder/air flow exits the funnel-shaped outlet.

With the foregoing and other objects in view there is also provided, in accordance with the invention, an apparatus for producing a large cloud of an electrostatically charged powder/air mixture with a high powder content, including: a dispersing device having a tube with an entry end, a length, an outlet end, a wall defining a hollow interior therein, a length in a range from 70 to 130 mm, an internal diameter in a range from 13 to 23 mm and the wall having a plurality of holes formed therein; a funnel-shaped outlet having an exit diameter in a range from 50 to 170 mm attached to the dispersing device; a nozzle attached to the entry end of the tube for introducing a fluidized powder being an air/powder flow axially into the hollow interior; compressed air used as control air introduced into the hollow interior tangentially through the plurality of holes at least at a first location at a distance of 80 to 95% of the length of the tube from the outlet end of the tube; and high-voltage electrodes disposed in a region where the powder/air flow exits the funnel-shaped outlet for electrostatically charging the powder/air flow as it exits the funnel-shaped outlet.

In this process, inside a hollow body a compressed-air stream is directed in the tangential direction onto the powder/air stream. The powder/air stream thus provided with a spin broadens out after its emergence to form a powder spraying cloud.

In the dispersion apparatus, the powder/air mixture flows through the hollow body. In its wall, the hollow body has drilled holes through which one or more compressed-air streams can be introduced tangentially.

It has been shown that, in order to spray powder/air mixtures with a high powder loading, and in order to produce relatively large spray clouds, specific geometric relationships of the hollow body and of the powder outlet opening are necessary.

Advantages of the process and of the dispersion apparatus reside, inter alia, in the fact that it is possible to operate with a high powder/air ratio, that is to say with a high powder loading. Powder depositions in the dispersion apparatus are largely avoided. The helical motion of the powder particles in the powder cloud, this motion being achieved with the dispersion apparatus, leads the powder particles past the high voltage electrodes, and close to them, with high probability and, as a result, effects improved electrostatic charging, which in turn leads to improved deposition of powder on a workpiece.

Other features which are considered as characteristic for the invention are set forth in the appended claims.

Although the invention is illustrated and described herein as embodied in a dispersion apparatus and a process for producing a large cloud of an electrostatically charged powder/air mixture, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1B:
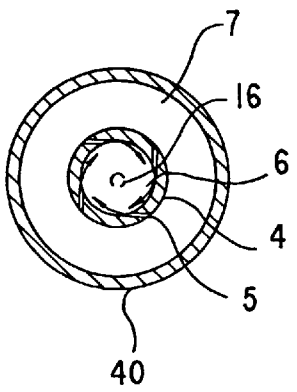
FIG. 1*b* is a cross-sectional view of FIG. 1*a* taken along the line I—I.

In all the figures of the drawing, sub-features and integral parts that correspond to one another bear the same reference symbol in each case. Referring now to the figures of the drawing in detail and first, particularly, to FIG. 1 thereof, there is shown a diagrammatic, sectional view of a fluidization vessel 2, in which only a portion of the intrinsically closed fluidization vessel 2 is shown. A fluidized powder 8 which is disposed in a fluidized bed in the vessel 2 can be withdrawn from the fluidized bed with the aid of a withdrawal pipe 25 under the control of a closing device 13. In the illustrated exemplary embodiment, the closing device 13 is in the form of a pipe opening in the withdrawal pipe 25. Compressed air that may be introduced through the pipe 25 forces fluidized powder 8 back into the vessel 2 in a closed state.

The fluidized powder 8 enters through a nozzle 11 into a dispersion apparatus 1 as a powder/air stream 16. The dispersion apparatus 1 is configured with a hollow space in a hollow body 3 that is formed by a pipe 4, the nozzle 11 acting as an inlet for the fluidized powder 8, and an outlet 12.

A plurality of drilled holes 5 that are formed in the pipe 4 are distributed in a row over the circumference of the pipe. It is also possible for a plurality of such rows of drilled holes 5 to be disposed one after another in the axial direction, that is to say in the spraying direction. The configuration of the drilled holes 5 can be seen more clearly from the cross-sectional view of FIG. 1*b*. The drilled holes 5 are constructed in such a way that compressed air introduced through the drilled holes 5 into the hollow space 3 as control air 6 contacts the powder/air stream 16 tangentially. As a result, a helical movement of the powder/air stream 16 develops and intensifies towards the outlet 12. The outlet 12 is configured to widen into a funnel shape, as a result of which, assisted by the centrifugal force of the rotating powder particles, a broadening powder cloud 15 is formed. The outlet diameter D of the outlet 12 is 100 mm in the example and may be between 50 mm and 170 mm, depending on the desired size of the powder cloud 15.

In the exemplary embodiment, the dispersion apparatus 1 is of double-wall construction, which produces an external chamber 7 into which the control air 6 is fed through a feed line 9 and from which the control air 6 can be introduced into the hollow space 3 through the drilled holes 5.

A very small baffle 10 is placed at a short distance downstream of the nozzle 11. This makes it possible to achieve the effect of causing the powder/air stream 16 to broaden somewhat, so that the control air 6 can achieve an intensified spinning action.

Charging of the powder particles is carried out with the aid of high-voltage electrodes 14 disposed outside an outlet region.

The shape of the powder cloud 15 can be influenced not only during operation through the use of the feeding of control air 6, but also beforehand by the selection and optimization of the geometry of the dispersion apparatus 1. Some significant parameters are specified in FIGS. 2 and 3.

Figure 1A:
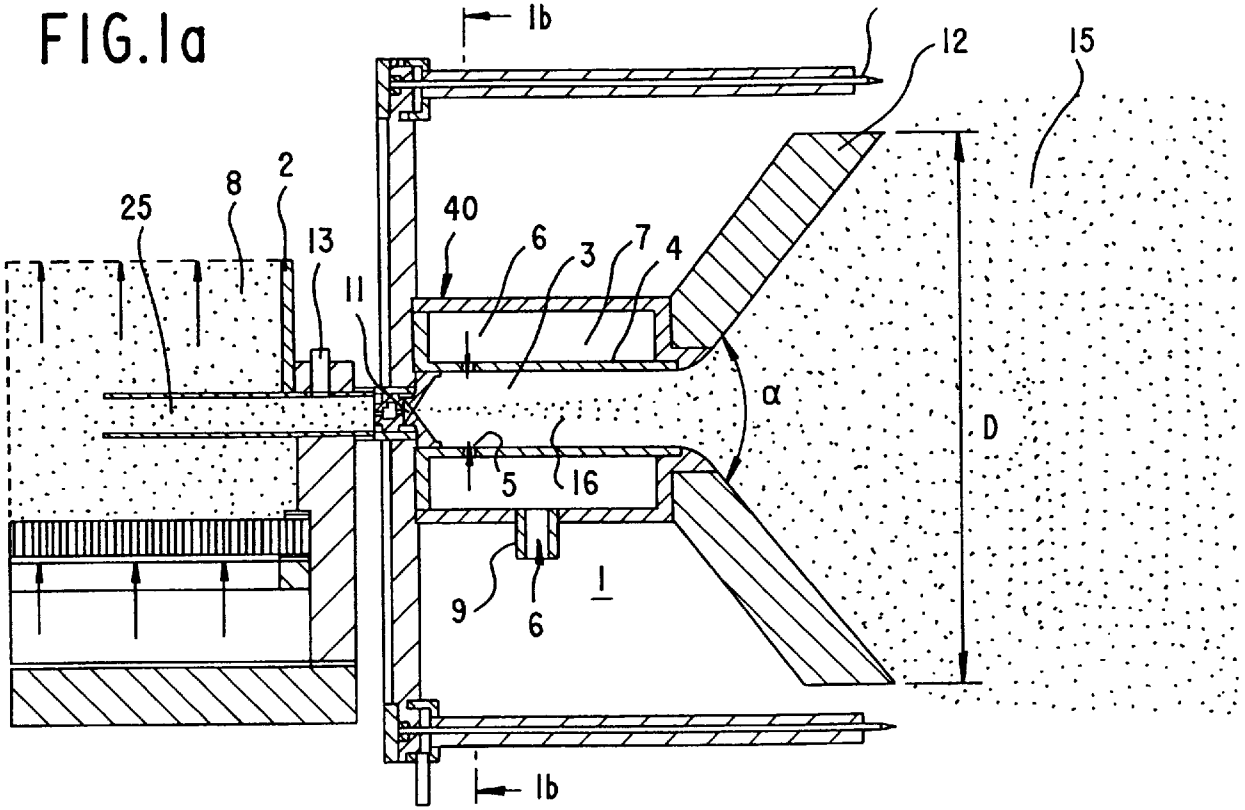
FIG. 1*a* is a diagrammatic, vertical-sectional view of a portion of a powder spraying apparatus to which a first variant of a dispersion apparatus having tangential introduction of control air is connected.
Figure 2:
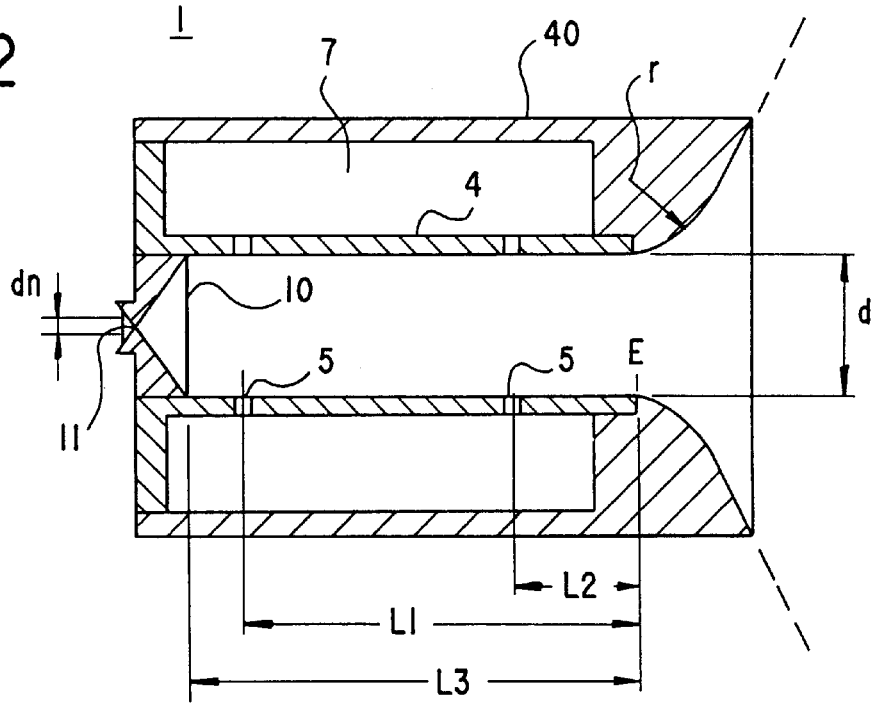
FIG. 2 is a sectional view of an example of the shaping and dimensioning of a variant of the dispersion apparatus with powder feed in a spraying direction.

FIG. 2 shows an exemplary embodiment of the axial introduction of fluidized powder into the dispersion apparatus 1 through the nozzle 11. The associated funnel-shaped outlet 12 with its outlet diameter D (FIG. 1) is only indicated, but not illustrated. Typical values or value ranges for dimensions are specified below, having been found to be optimal in an exemplary embodiment and being suitable for powder/air mixtures with a high powder loading and for powder expulsion rates of 200 to 600 g/min. A large powder cloud can be produced with the values specified.

In FIG. 2, the pipe 4 has a length L3 of 100 mm, and this should lie in the range from 70 mm to 130 mm. The distance L1, measured from an end E of the pipe 4, of a first row of four to ten drilled holes 5, which are disposed distributed around the circumference of the pipe 4, is in the range from 80% to 95% of the length L3. The distance L2, measured from the end E of the pipe, of a second row of likewise four to ten drilled holes 5 lies in the range from 15 to 35% of the length L3.

The internal diameter d of the pipe 4 is 17 mm in the example and should lie in the range from 13 to 23 mm. The radius r at the transition from the pipe 4 into the outlet funnel 12 is 3 mm in the example. The aperture angle $\alpha$ of the funnel 12 (see FIG. 1) is 90° in the example and, depending on the size of the funnel 12, may lie in the range from 60° for small funnels to 160° for large funnels. The inlet opening dn of the nozzle 11 has a diameter of 1.0 mm to 1.4 mm.

Figure 3:
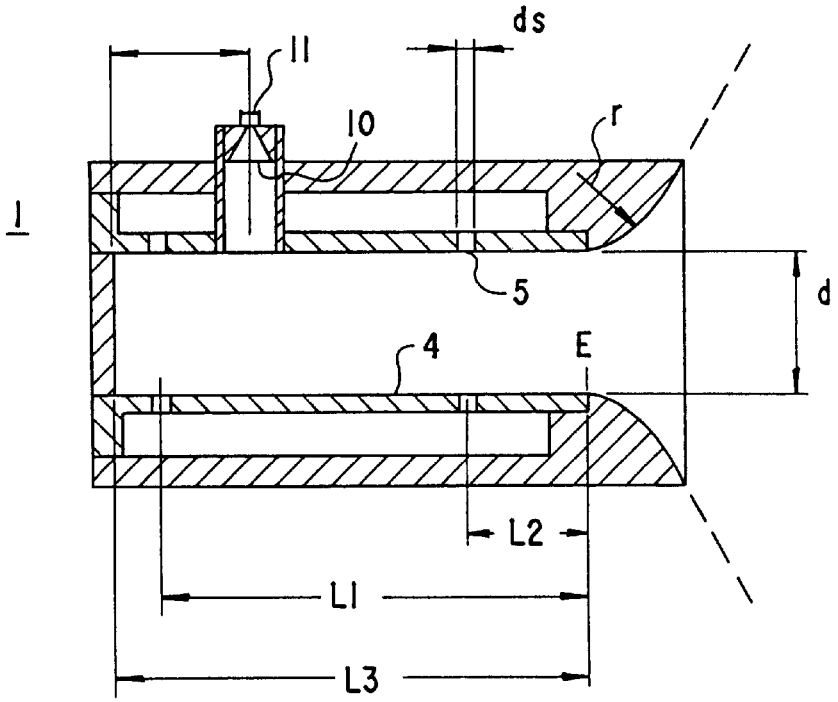
FIG. 3 is a sectional view of an example of a variant with powder feed transversely to the spraying direction.

FIG. 3 shows an exemplary embodiment in which the introduction of the fluidized powder is carried out at a point located a=28 mm from the start of the pipe 4, or generally at a point located at 65 to 75% of the pipe length L3 from the end E. Otherwise, the values cited in relation to FIG. 2 apply. The diameter ds of the drilled holes 5 may be 1.0 to 2.0 mm in every case.

It goes without saying that the control air 6 is fed only in such an amount as is necessary for the formation of the desired shape of the powder cloud 15, since the control air 6 reduces the powder density in a manner which is undesirable per se.

The dispersion apparatus proposed, or the process proposed at the same time, for influencing the shape of the emerging powder cloud are therefore particularly suitable as a dispersion apparatus in conjunction with a spraying apparatus which operates with a powder/air mixture with a high proportion of powder, such as the spraying apparatus indicated in FIG. 1.

We claim:

1. A method for producing a large cloud of an electrostatically charged powder/air mixture with a high powder content, which comprises:

providing a dispersing device having a tube, a nozzle connected to an entry end of the tube, and a funnel-shaped outlet having an exit diameter from 50 to 170 mm connected to an outlet end of the tube, the tube having a length in a range from 70 to 130 mm, an internal diameter in a range from 13 to 23 mm, a wall defining a hollow interior therein, and a plurality of holes formed in the wall of the tube;

introducing a fluidized powder being a powder/air flow into the hollow interior axially at the entry end of the tube;

introducing compressed air as control air into the hollow interior tangentially through the plurality of holes in the tube at least at a first location at a distance of 80 to 95% of the length of the tube from the outlet end of the tube, the control air being introduced tangentially to the air/powder flow for providing the air/powder flow with a tangential impulse in addition to an axial impulse; and electrostatic charging the air/powder flow with high-voltage electrodes in a region where the powder/air flow exits the funnel-shaped outlet.

2. The method according to claim 1, which comprises distributing the plurality of holes for tangentially introducing the control air in a form of a ring on the wall of the tube both at the first location and at a second location at a distance of 15 to 35% of the length of the tube from the outlet end of the tube.

3. A method for producing a large cloud of an electrostatically charged powder/air mixture with a high powder content, which comprises:

providing a dispersing device having a tube, a nozzle connected to an entry end of the tube, and a funnel-shaped outlet having an exit diameter from 50 to 170 mm connected to an outlet end of the tube, the tube having a length in a range from 70 to 130 mm, an internal diameter in a range from 13 to 23 mm, a wall defining a hollow interior therein, and a plurality of holes formed in the wall of the tube;

introducing a fluidized powder being a powder/air flow into the hollow interior transversely at a location situated at a distance of 65 to 75% of the length of the tube from the outlet end of the tube;

introducing compressed air as control air into the hollow interior tangentially through the plurality of holes in the tube at least at a first location at a distance of 80 to 95% of the length of the tube from the outlet end of the tube, the control air being introduced tangentially to the air/powder flow for providing the air/powder flow with a tangential impulse in addition to an axial impulse; and electrostatic charging the powder/air flow with high-voltage electrodes in a region where the powder/air flow exits the funnel-shaped outlet.

4. The method according to claim 3, which comprises distributing the plurality of holes for tangentially introducing the control air in a form of a ring on the wall of the tube both at the first location and at a second location at a distance of 15 to 30% of the length of the tube from the outlet end of the tube.

5. An apparatus for producing a large cloud of an electrostatically charged powder/air mixture with a high powder content, comprising:

a dispersing device having a tube with an entry end, a length, an outlet end, a wall defining a hollow interior therein, a length in a range from 70 to 130 mm, an internal diameter in a range from 13 to 23 mm and said wall having a plurality of holes formed therein;

a funnel-shaped outlet having an exit diameter in a range from 50 to 170 mm attached to said dispersing device;

a nozzle attached to said entry end of said tube for introducing a fluidized powder being an air/powder flow axially into the hollow interior;

compressed air used as control air introduced into said hollow interior tangentially through said plurality of holes at least at a first location at a distance of 80 to 95% of said length of said tube from said outlet end of said tube; and high-voltage electrodes disposed in a region where the powder/air flow exits said funnel-shaped outlet for electrostatically charging the powder/air flow as it exits said funnel-shaped outlet.

6. The apparatus according to claim 5, wherein said nozzle has a passage opening formed therein having a width in a range of 1.0 to 1.4 mm.

7. The apparatus according to claim 5, wherein said plurality of holes for introducing the control air have a diameter of from 1.0 to 2.0 mm.

8. The apparatus according to claim 5, wherein said dispersing device has a further wall, said further wall and said wall of said tube defining a double-walled configuration with an outer chamber formed there-between, the control air being introduced into said outer chamber and guided tangentially onto the powder/air flow through said plurality of holes formed in said wall of said tube.

9. The apparatus according to claim 5, wherein said plurality of holes distributed on said tube in a form of a ring both over the first location and over a second location at a distance of from 15 to 35% of said length of said tube from said outlet end of said tube.

10. The apparatus according to claim 9, wherein four to ten holes of said plurality of holes are disposed at both the first location and the second location.

11. An apparatus for producing a large cloud of an electrostatically charged powder/air mixture with a high powder content, comprising:

a dispersing device having a tube with an entry end, a length, an outlet end, a wall defining a hollow interior therein, a length in a range from 70 to 130 mm, an internal diameter in a range from 13 to 23 mm and said wall having a plurality of holes formed therein;

a funnel-shaped outlet having an exit diameter in a range from 50 to 170 mm and attached to said dispersing device;

a nozzle attached transversely to said tube at a location at a distance of 65 to 75% of said length of said tube from said outlet end of said tube for introducing transversely a fluidized powder being an air/powder flow to the hollow interior;

compressed air used as control air introduced into said hollow interior tangentially through said plurality of holes at least at a first location at a distance of 80 to 95% of said length of said tube from said outlet end of said tube; and high-voltage electrodes disposed in a region where the powder/air flow exits said funnel-shaped outlet for electrostatically charging the powder/air flow as it exits said funnel-shaped outlet.

12. The apparatus according to claim 11, wherein said nozzle has a passage opening formed therein having a width in a range of 1.0 to 1.4 mm.

13. The apparatus according to claim 11, wherein said plurality of holes for introducing the control air have a diameter of from 1.0 to 2.0 mm.

14. The apparatus according to claim 11, wherein said dispersing device has a further wall, said further wall and said wall of said tube defining a double-walled configuration with an outer chamber formed there-between, the control air introduced into said outer chamber and guided tangentially onto the powder/air flow through said plurality of holes formed in said wall of said tube.

15. The apparatus according to claim 11, wherein said plurality of holes distributed on said tube in a form of a ring both over the first location and over a second location at a distance of from 15 to 35% of said length of said tube from said outlet end of said tube.

16. The apparatus according to claim 15, wherein four to ten holes of said plurality of holes are disposed at both the first location and the second location.

* * * * *